US007815520B2

(12) United States Patent
Frame et al.

(10) Patent No.: US 7,815,520 B2
(45) **Date of Patent: *Oct. 19, 2010**

(54) GOLF CLUB HEAD

(75) Inventors: Nick Frame, Vista, CA (US); Maresala Milo, San Diego, CA (US); Jose Miraflor, Oceanside, CA (US); Marni Ines, San Marcos, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/150,084

(22) Filed: Apr. 23, 2008

(65) Prior Publication Data

US 2008/0200282 A1 Aug. 21, 2008

Related U.S. Application Data

(63) Continuation of application No. 11/510,049, filed on Aug. 24, 2006, now Pat. No. 7,396,295.

(51) Int. Cl.
*A63B 53/04* (2006.01)
*A63B 53/06* (2006.01)

(52) U.S. Cl. ..... 473/329; 473/335; 473/340; 473/350

(58) Field of Classification Search ..... 473/324–350
See application file for complete search history.

(56) References Cited

U.S. PATENT DOCUMENTS 1,222,770 A 4/1917 Kaye
1,705,997 A 3/1929 Quynn
D207,228 S 3/1967 Solheim
3,841,640 A 10/1974 Gaulocher
D235,668 S 7/1975 Swash
5,533,728 A 7/1996 Pehoski et al.
5,643,109 A 7/1997 Rose et al.
5,685,784 A 11/1997 Butler
5,820,481 A 10/1998 Raudman
D437,017 S 1/2001 Ford
6,350,208 B1 2/2002 Ford
6,471,600 B2 10/2002 Tang et al.

(Continued)

OTHER PUBLICATIONS

Internet website, "Odyssey 2-Ball Putter," www.drputt.com/Ody2BallPutter.htm (3 pages).

(Continued)

*Primary Examiner*—Alvin A Hunter
(74) *Attorney, Agent, or Firm*—Klarquist Sparkman, LLP

(57) ABSTRACT

A putter head comprising a body having an open, frame-like structure having an improved mass distribution for optimizing the moment of inertia and placement of the center of gravity. The body includes a front portion, a rear portion, toe and heel portions extending between and interconnecting respective ends of the front and rear portions, and a central portion interconnecting the front and rear portions along the longitudinal axis of the body. A first main opening of the body is bounded by the toe portion, the central portion, and part of the front portion. A second main opening of the body is bounded by the heel portion, the central portion, and part of the front portion. The heel and toe portions desirably are formed with respective elongated openings extending substantially the entire lengths of the heel and toe portions.

19 Claims, 4 Drawing Sheets

U.S. PATENT DOCUMENTS

| | | | | |
|---|---|---|---|---|
| 6,506,125 | B2 | 1/2003 | Helmstetter et al. | |
| 6,692,378 | B2 | 2/2004 | Shmoldas et al. | |
| 6,716,110 | B1 | 4/2004 | Ballow | |
| 6,796,911 | B2 | 9/2004 | Grace | |
| D503,445 | S | 3/2005 | Vartan Toroussian | |
| 6,896,625 | B2 | 5/2005 | Grace | |
| 6,929,559 | B1 | 8/2005 | Grace | |
| 6,929,564 | B2 | 8/2005 | Olsavsky et al. | |
| 6,974,394 | B1 | 12/2005 | Tang et al. | |
| 6,988,956 | B2 | 1/2006 | Cover et al. | |
| 6,988,959 | B2 | 1/2006 | Pollman | |
| D521,582 | S | 5/2006 | Souza et al. | |
| 7,048,646 | B2 | 5/2006 | Yamanaka et al. | |
| 7,052,411 | B2 | 5/2006 | Solheim et al. | |
| D523,102 | S | 6/2006 | Stites et al. | |
| 7,147,569 | B2 | 12/2006 | Tang et al. | |
| 7,156,752 | B1 | 1/2007 | Bennett | |
| 7,160,203 | B2 | 1/2007 | Bonneau | |
| 7,163,463 | B2 | 1/2007 | Mills | |
| 7,166,036 | B2 * | 1/2007 | Byrne et al. | 473/242 |
| D538,364 | S | 3/2007 | Frame et al. | |
| 7,244,189 | B1 | 7/2007 | Stobbe | |
| 7,244,191 | B2 | 7/2007 | Tang et al. | |
| D552,197 | S | 10/2007 | Wells et al. | |
| 7,344,451 | B2 | 3/2008 | Tang et al. | |
| 2002/0034986 | A1 | 3/2002 | Helmstetter et al. | |
| 2002/0123393 | A1 | 9/2002 | Tang et al. | |
| 2003/0228925 | A1 | 12/2003 | Rohrer | |
| 2004/0132542 | A1 | 7/2004 | Olsavsky et al. | |
| 2005/0137027 | A1 | 6/2005 | Thomas | |
| 2005/0159241 | A1 | 7/2005 | Hou | |
| 2005/0159242 | A1 | 7/2005 | Solheim et al. | |
| 2005/0227777 | A1 | 10/2005 | Cover et al. | |
| 2005/0282657 | A1 | 12/2005 | Solheim et al. | |
| 2006/0014590 | A1 | 1/2006 | Tao | |
| 2006/0068934 | A1 | 3/2006 | Tang et al. | |
| 2006/0068935 | A1 | 3/2006 | Tang et al. | |
| 2006/0094522 | A1 | 5/2006 | Tang et al. | |
| 2006/0166755 | A1 | 7/2006 | Brown | |
| 2006/0189408 | A1 | 8/2006 | Grace | |

OTHER PUBLICATIONS

Internet website, "Ping CRAZ-E Putter," www.utahgolf.net/product460.htm1(1 page).
Internet website of Callaway Golf I-Trax putter, www.callawaygolf.com/en/ProductCatalog.aspx?type=8 (1 page).
Internet website of Ray Cook Golf Super Gyro 1, Super Gyro 2, Super Gyro 3, and Super Gyro 4 clubs, www.raycookgolf.com/supergyro_series.htm (2 pages), www.ravcookgolf.com/gyro_series.htm (3 pages).
Internet website of Never Compromise Inc. Voodoo putters, www.nevercompromise.com/nevercompromise.html (1 page).
Internet website of Nike BC OZ T100 putter, www.nike.com/nikegolf/flash_reg.jhtml.
Sales literature, Callaway Golf I-Trax Putter (1 page).
Sales literature, MacGregor V-Foil and M-Series putters (1 page).
Images of Ben Hogan Baby Ben putter (2 pages).
Images of Ben Hogan Hawk putter (2 pages).
Images of MacGregor V-Foil putter (5 pages).
Images of Odyssey putters (1 page).
Images of Ping putters (1 page).
Images of Scotty Cameron Phantom putters (3 pages).
Statement of Steven Crocker dated Mar. 14, 2007 (1 page).
Notice of Allowance for U.S. Appl. No. 11/510,049.
Supplemental Notice of Allowability, dated Jun. 11, 2008, in U.S. Appl. No. 11/510,049.

* cited by examiner

GOLF CLUB HEAD

CROSS-REFERENCE TO RELATED APPLICATION

The present application is a continuation of U.S. application Ser. No. 11/510,049, filed Aug. 24, 2006, now U.S. Pat. No. 7,396,295 which is incorporated herein by reference.

FIELD

The present disclosure concerns embodiments of a golf club head, and in particular, a head for a golf putter.

BACKGROUND

Numerous golf putters have been designed to help players achieve greater accuracy when putting a golf ball. Generally speaking, most golf putters are variations of either a blade-type putter head or a mallet-type putter head. The mallet-type putter head has a relatively large head that typically is semi-circular or trapezoidal in shape as viewed from above, while the blade-type putter head has a relatively narrow or blade-like head.

Accuracy of a putt depends on several factors, including where the strike face impacts the ball, the location of the center of gravity of the putter head, and the rotational moment of inertia about a vertical axis extending through the center of gravity of the putter head. Moment of inertia is a measure of the club's ability to resist twisting from an off-center hit when the ball does not impact the sweet spot of the putter head. The greater the moment of inertia, the less likely the club will twist in the player's hand and cause a misdirected shot. Redistributing mass away from the striking face toward the rear of a putter head tends to increase the moment of inertia about the impact location. Moreover, decreasing the distance between the center of gravity and the bottom of the putter head can increase the launch angle of the ball, as well as promote earlier forward rotation of the ball for greater directional stability and speed control.

Due to their relatively large footprints, mallet-type putters can achieve higher moments of inertia than blade-type putters. While numerous modifications have been made to mallet-type golf putters to optimize the moment of inertia and the location of the center of gravity, there is a continuing need to improve the functionality, look, and feel of such putters.

SUMMARY

According to one aspect, a putter head comprises a body having an open, frame-like structure having an improved mass distribution that allows the center of gravity to be moved rearwardly from the putter head front face and downwardly toward the putter head bottom surface. The improved mass distribution also results in an increased moment of inertia about the center of gravity that better resists twisting of the club from an off-center hit.

The body can be made of any of various suitable materials, such as stainless steel. In particular embodiments, the body includes a front portion, a rear portion, toe and heel portions extending between and interconnecting respective ends of the front and rear portions, and a central portion interconnecting the front and rear portions along the longitudinal axis of the body. A first main opening of the body is bounded by the toe portion, the central portion, and part of the front portion. A second main opening of the body is bounded by the heel portion, the central portion, and part of the front portion. The heel and toe portions desirably are formed with respective elongated openings extending substantially the entire lengths of the heel and toe portions.

The front portion can comprise a vertically disposed front plate extending laterally between the heel and toe portions and a crown portion extending rearwardly from the upper end of the front plate. The central portion can comprise a vertically disposed rear plate spaced rearwardly from the front plate and extending downwardly from the crown portion. The central portion can also include an enlarged aft-mass portion and a vertically disposed, longitudinally extending plate interconnecting the rear plate and the aft-mass portion. The aft-mass portion desirably is formed with one or more cavities adapted to house respective one or more removable weights. The rear portion of the body can be formed with openings in communication with the cavities for inserting and removing the weights therefrom.

In certain embodiments, the putter head has a moment of inertia about the putter head center of gravity of greater than 400 kg-mm$^2$, and a center of gravity located greater than 30 mm from the front face and less than 13 mm from the bottom surface of the putter head. It is believed that these properties have never before been achieved in a golf putter head having an overall size and weight that conforms to USGA rules. Although variable, the putter head desirably has an overall weight that ranges from about 320 grams to about 355 grams.

In an exemplary embodiment, the putter head has a moment of inertia of about 404 kg-mm$^2$, a center of gravity located about 33.6 mm from the front face and about 12.5 mm from the bottom surface, and a weight of about 345 grams.

The foregoing and other objects, features, and advantages of the invention will become more apparent from the following detailed description, which proceeds with reference to the accompanying figures.

DETAILED DESCRIPTION

Figure 1:
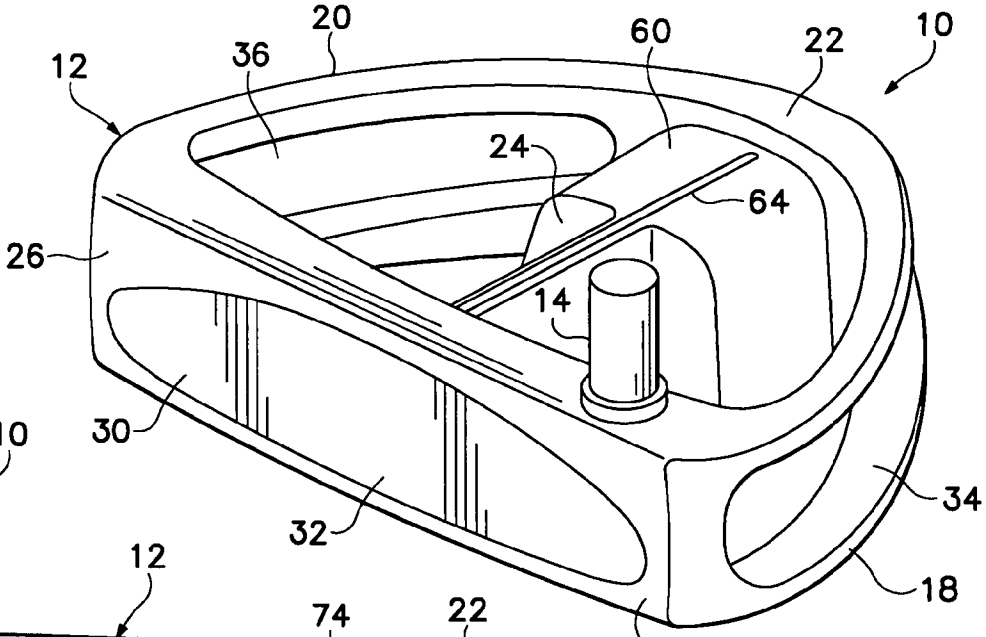
FIG. 1 is a perspective view of a putter head, according to one embodiment.

As used herein, the singular forms "a," "an," and "the" refer to one or more than one, unless the context clearly dictates otherwise.

As used herein, the term "includes" means "comprises."

Referring to the figures, there is shown a putter head 10, according to one embodiment, which is used to putt a ball (not shown) toward a hole (not shown). The putter head 10 generally comprises a main body 12 and an upwardly extending hosel 14 coupled to the body. The hosel 14 allows the putter head 10 to be connected to a golf club shaft (not shown) in a conventional manner. Other known techniques or mechanisms can be used to connect the shaft to the body 12.

The body 12 in the illustrated configuration comprises an open, frame-like structure having a front, or face, portion 16, a heel portion 18, a toe portion 20, a rear portion 22, and a central portion or truss member, 24. The heel and toe portions 18, 20 (also referred to herein as side portions) are connected to respective ends of the face portion 16 and converge in the rearward direction (toward the rear portion 22). As shown, the heel and toe portions 18, 20 are slightly curved so as to smoothly merge into the rear portion 22. The central portion 24 extends from the face portion 16 to the rear portion 22 and is centered on a longitudinal axis of symmetry A (FIG. 3) of the body 12. It should be understood that the axis A extends through the sweet spot of the front portion 16. The illustrated body 12 has a generally triangular shape with rounded corners as viewed from above. The rounded corners soften the overall look of the putter head 10 so as to provide an aesthetically pleasing shape. However, other shapes also can be employed. For example, the body 12 can be formed without rounded corners and/or can have substantially straight heel and toe portions 18, 20 that converge in a direction extending from the face portion 16 to the rear portion 22. In other embodiments, the body 12 can have a generally rectangular or square footprint (as viewed from above).

The face portion 16 has a front face 26 that is formed with a recess 28 (FIG. 4) for receiving an insert 30. The insert 30 defines a front striking surface 32 for contacting a golf ball. The insert 30 can have any of various configurations known in the art. Known inserts, for example, can have grooves, projections, beams, or other surface structures to improve control or accuracy of a putt. In particular embodiments, the insert 30 includes a plurality of horizontally extending, vertically spaced projections collectively defining a striking surface for contacting a golf ball, such as disclosed in co-pending U.S. application Ser. No. 11/051,161, which is incorporated herein by reference. While the insert 18 in the illustrated embodiment is generally elliptical, the insert can also comprise any other geometric shape, such as a rectangle, square, circle, or combinations thereof. In other embodiments, the putter head 10 does not include an insert 30 and the front face 26 is not formed with a recess 28. In the latter embodiments, grooves, projections, beams, or other surface structures can be formed directly in the front face 26.

Figure 4:
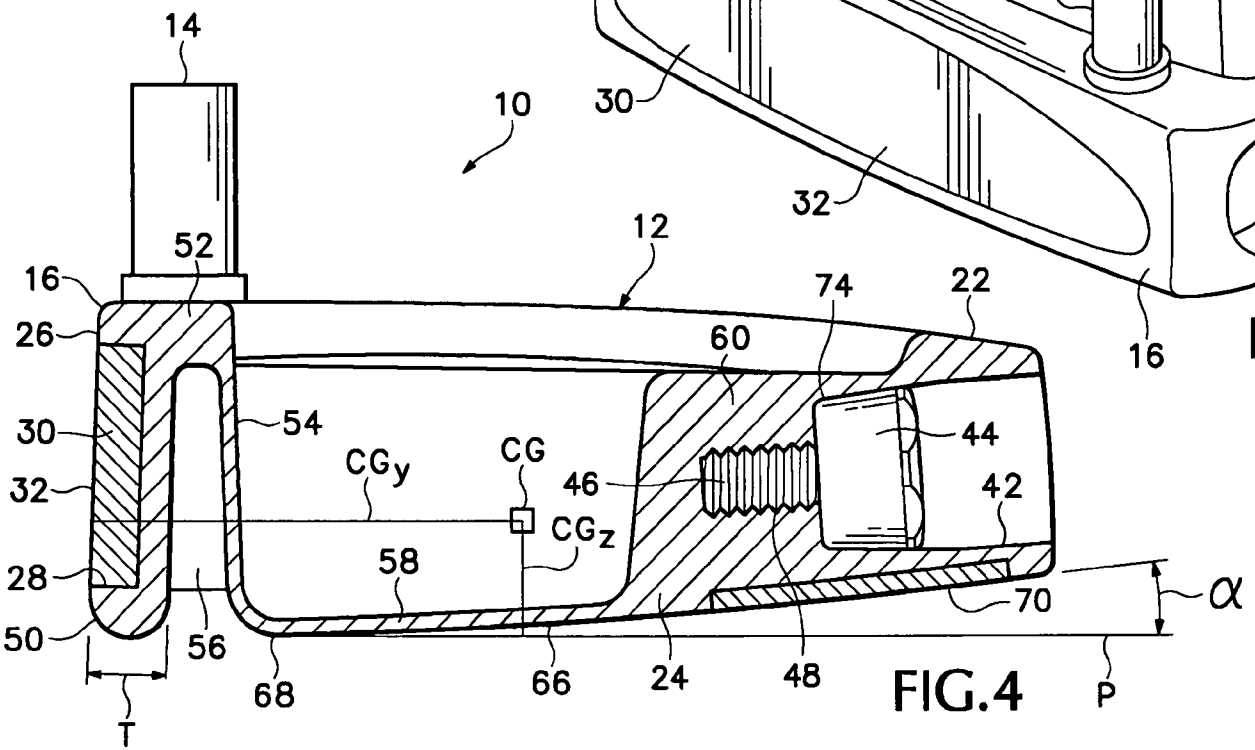
FIG. 4 is a cross-sectional view of the putter head taken along line 4-4 of FIG. 3.
Figure 8:
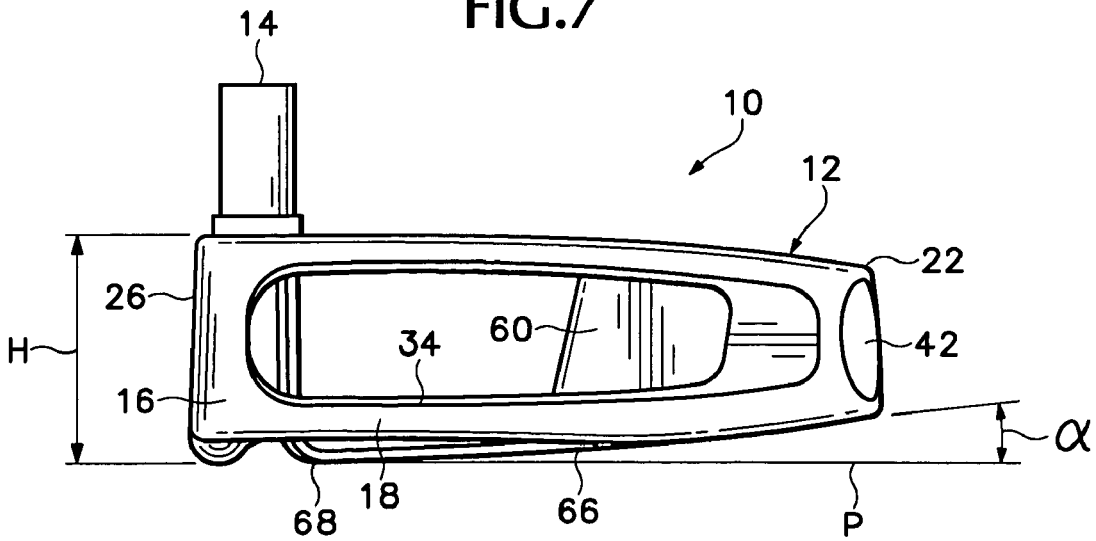
FIG. 8 is a side elevation view of the putter head of FIG. 1.

As shown in FIGS. 4 and 8, the front face 26 can be oriented to provide a loft angle as shown (the front face is angled rearwardly from the bottom edge to the top edge of the face with respect to a vertical plane) to impart a launch angle to the ball upon impact. Alternatively, the front face 26 can be disposed parallel to the vertical plane and perpendicular to a horizontal ground plane P.

Figure 2:
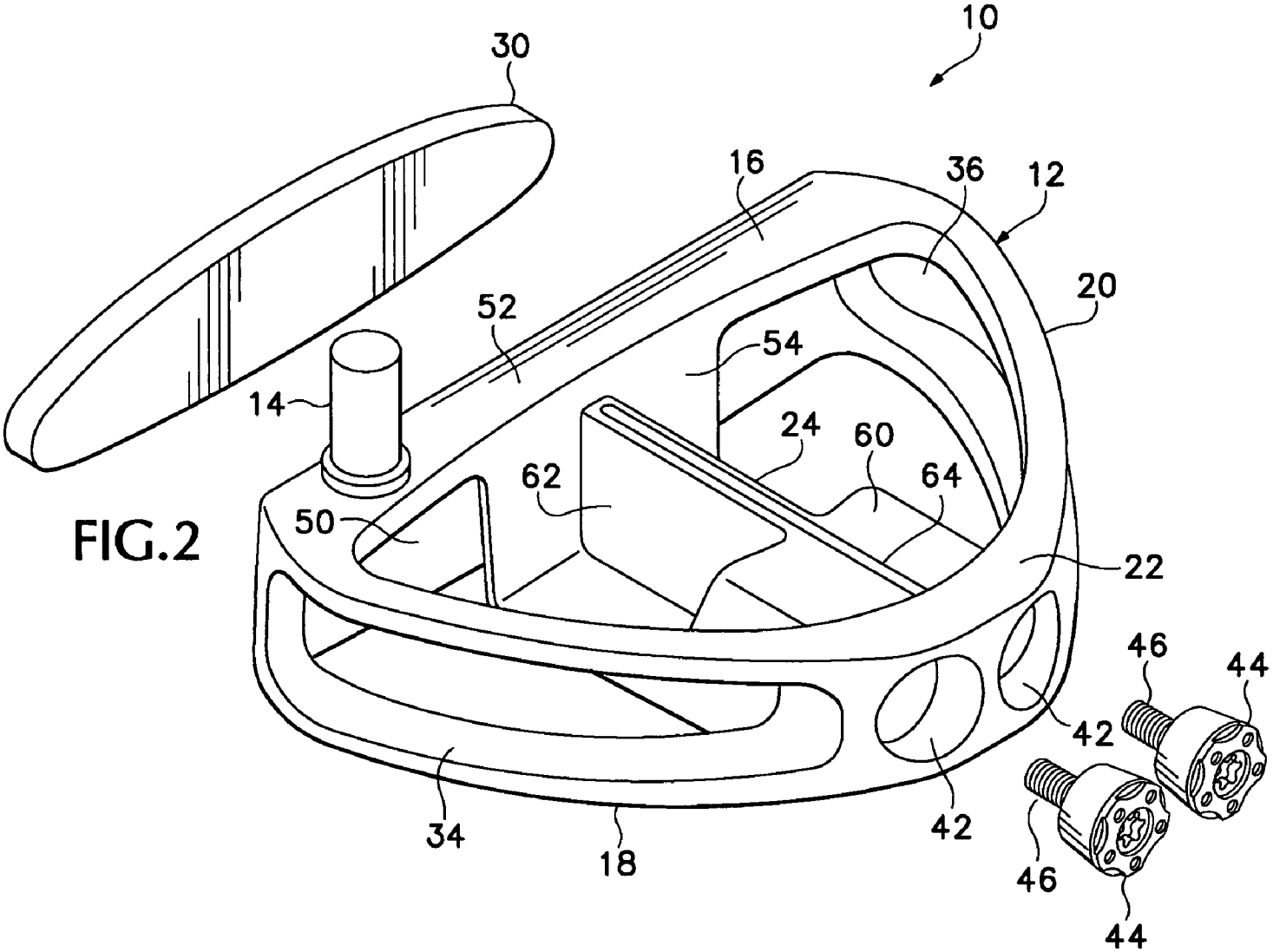
FIG. 2 is a perspective, exploded view of the putter head of FIG. 1.
Figure 3:
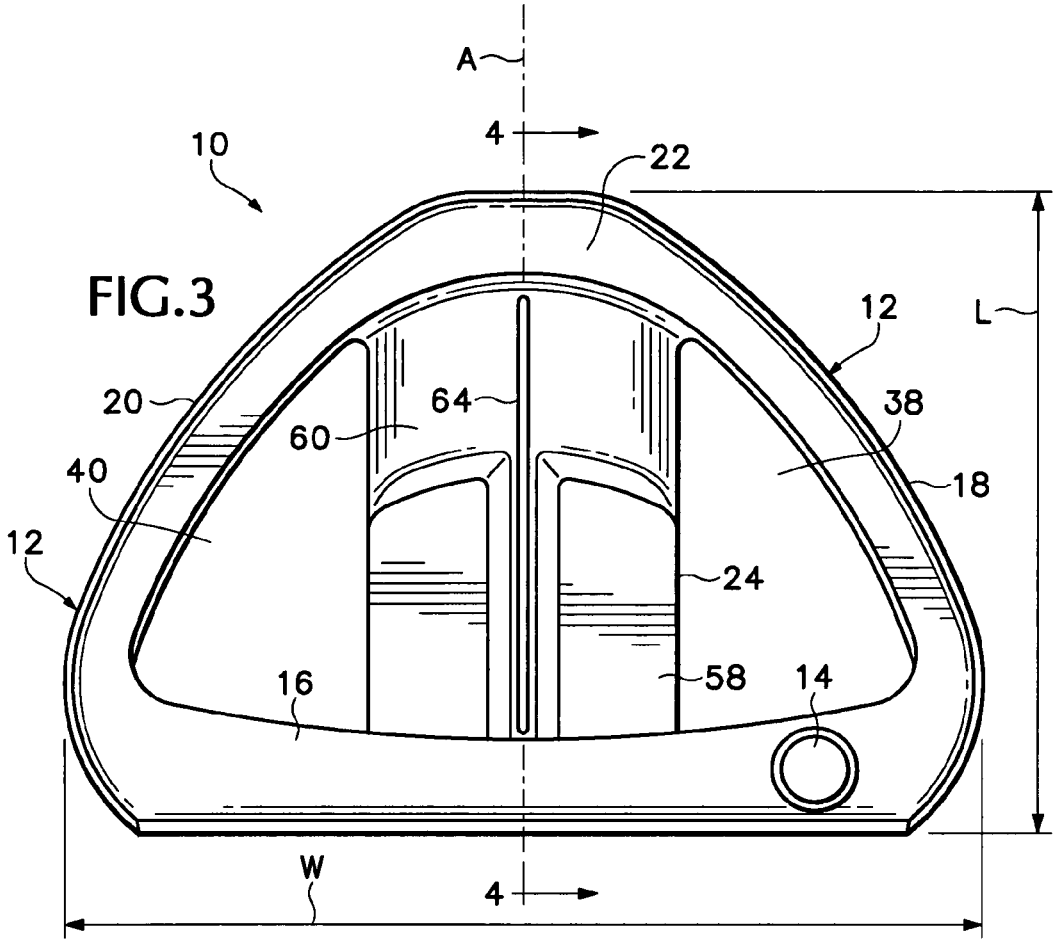
FIG. 3 is a top plan view of the putter head of FIG. 1.
Figure 5:
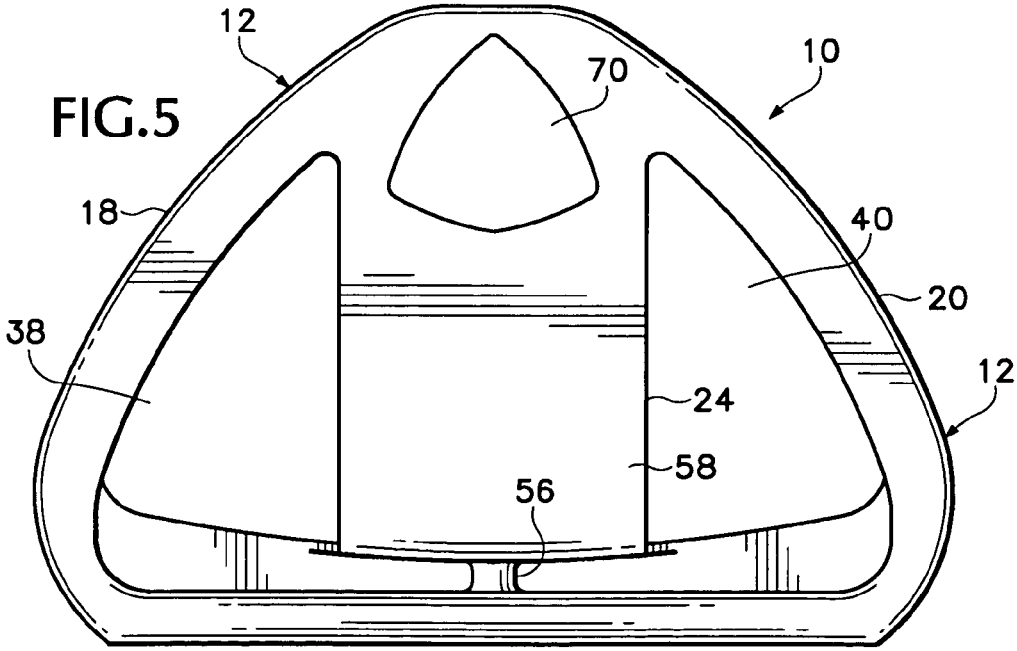
FIG. 5 is a bottom plan view of the putter head of FIG. 1.
Figure 6:
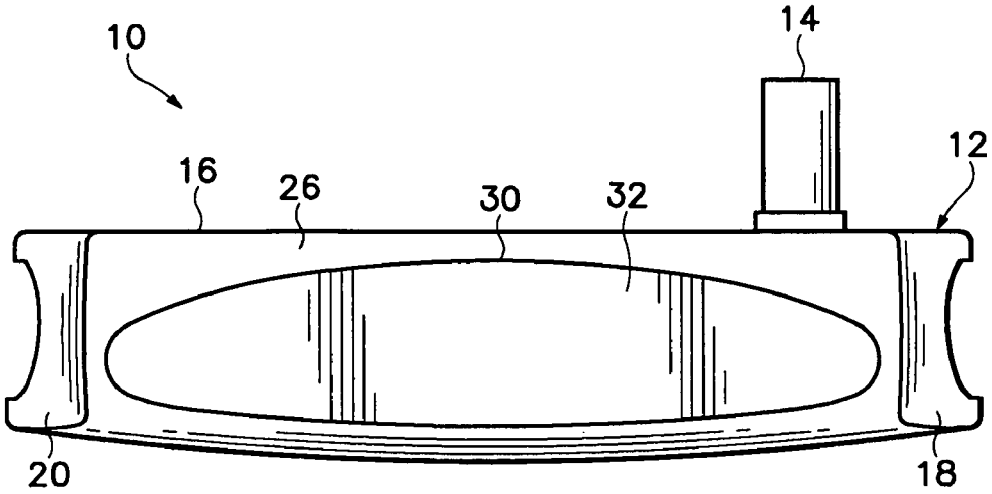
FIG. 6 is a front elevation view of the putter head of FIG. 1.
Figure 7:
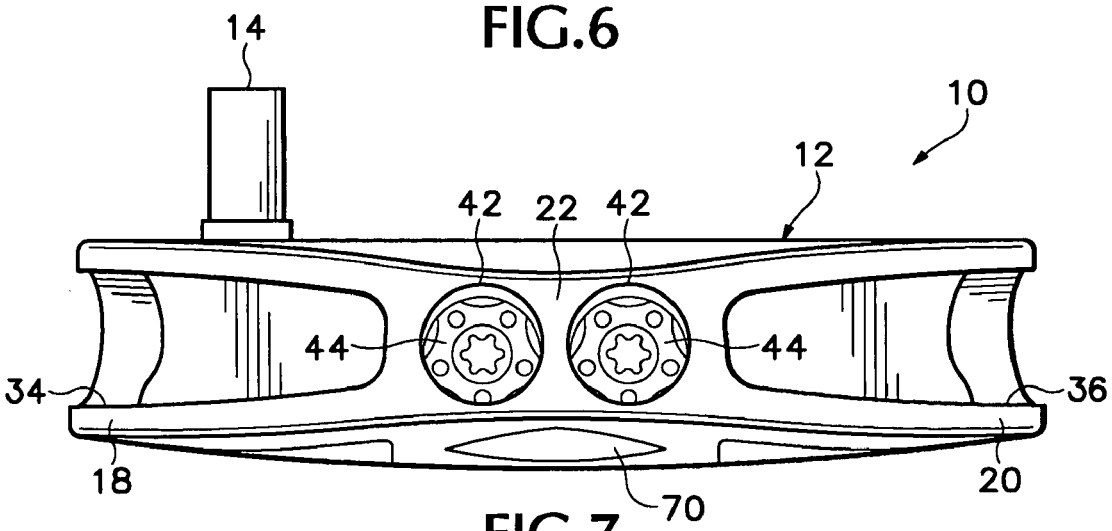
FIG. 7 is a rear elevation view of the putter head of FIG. 1.

As best shown in FIGS. 3 and 5, the heel portion 18, the central portion 24, and an adjacent portion of the face portion 16 define a first main opening, or aperture, 38, while the toe portion 20, the central portion 24, and an adjacent portion of the face portion 16 define a second main opening, or aperture, 40. The heel and toe portions 18, are formed with respective elongated slots 34, 36 (FIGS. 1 and 2) extending the majority of the lengths of the heel and toe portions and desirably extending substantially the entire lengths of the toe and heel portions as shown. In some implementations, the heel and toe portions 18, 20 are not formed with slots 34, 36. For example, if a greater swing weight is required, such as if the putter head is used in a "belly" putter (a putter having a shaft length that is greater than that of a standard shaft), the heel and toe portions 18, 20 are solid without any openings or slots.

The central portion 24 includes an enlarged aft-mass portion 60 connected to the rear portion 22. The aft-mass portion 60 is formed with two cavities 74 (one of which is shown in FIG. 4) positioned on opposite sides of the longitudinal axis A and adapted to house respective removable weights 44. The rear portion 22 is formed with openings 42 in communication with the cavities 74 for inserting and removing the weights therefrom. In this manner, a user can increase or decrease the overall weight of the putter head 10 to suit the user's skill level or playing style. The weights 44 can have a screw-like configuration as shown with respective threaded shafts 46 that are tightened into respective threaded bores 48 formed in the aft-mass portion 60 and in communication with the cavities 74 (FIG. 4).

In alternative embodiments, the putter head 10 can be adapted to receive a single weight 44 (which can be housed in a cavity centered on the longitudinal axis A) or more than two weights. In still alternative embodiments, the weights 44 can be secured to the putter head 10 using other techniques or mechanisms and/or the weights 44 can be secured at other locations on the putter head. In another embodiment, the putter head 10 does not include any removable weights 44. Suitable materials for the weights 44 include, for example, brass, steel, tungsten, nickel, bronze and alloys thereof.

As best shown in FIG. 4, the front portion 16 comprises a generally vertically disposed, laterally extending front plate 50 that defines recess 28, and a crown portion 52 that extends rearwardly from an upper edge of the front plate 50 and laterally between the opposite ends of the front portion 16. The central portion 24 includes a generally vertically disposed, laterally extending rear plate 54 spaced rearwardly from the front plate 50. The rear plate 54 is connected to and extends downwardly from the rear edge of the crown portion 52. As best shown in FIG. 2, the rear plate 54 is centered with respect to the sweet spot of the putter head 10 and has a truncated width (measured in the direction from the heel portion 18 to the toe portion 20) that is less than the width of the front plate 50. As shown in FIG. 5, a vertical rib 56 extends between the rear surface of the front plate 50 and the front surface of the rear plate 54 to provide an additional connection between the face portion 16 and the central portion 24.

The central portion 24 in the illustrated configuration also includes a generally horizontally disposed bottom plate 58 (also referred to herein as a sole plate) and a vertically disposed, longitudinally extending plate 62 interconnecting the aft-mass portion 60 to the rear plate 54 along the longitudinal axis A of the putter head 10. The putter head 10 can include one or more alignment markings or aids for lining up a putt. In the illustrated embodiment, for example, an alignment groove 64 is formed in the upper surface of the vertical plate 62 and the aft-mass portion 60 along the longitudinal axis A of the putter head 10. Other types of visual alignment aids, such as triangles, arrow heads, circles, and/or combinations thereof can be provided at convenient locations on the surface of the putter head 10.

As shown in FIGS. 4 and 8, the central portion 24 and the rear portion 22 form a bottom surface 66 of the club head that curves slightly upwardly from the rear plate 54 to the trailing edge of the rear portion 22 at an angle $\alpha$ with respect to a horizontal ground plane P. Although variable, the angle $\alpha$ in certain embodiments is about 6.6 degrees. The lowermost point on the bottom surface 66, indicated at 68, as well as the bottom edge of front portion 16, extend slightly below the heel and toe portions 18, 20. In other embodiments, however, the putter head 10 can be formed with a bottom surface 66 that is flat. The bottom surface 66 optionally can be formed with a recess for receiving a small plate or badge 70 (FIG. 5) for displaying the make, model, and/or other information relating to the putter head 10.

Although variable, the putter head 10 may weigh from about 280 grams to about 510 grams (including weights 44), and desirably weighs from about 275 grams to about 400 grams (including weights 44), and more desirably from about 320 grams to about 355 grams (including weights 44).

Although variable, each weight 44 desirably weighs from about 1 gram to about 14 grams. In certain embodiments, each weight 44 weighs from about 2 grams to about 6 grams.

The frame-like structure of the putter head 10 enables an improved mass distribution that allows the center of gravity, CG, to be moved rearward from the front face 26 and downward toward the bottom surface 66. That is, the CG can be moved farther from the front face 26 and closer to the bottom surface 66 without increasing the overall weight of the putter head 10. Moving the CG rearward and downward increases the launch angle of the golf ball, and promotes forward rotation of the ball for greater directional stability and speed control. The improved mass distribution also results in an increased heel-to-toe moment of inertia (MOI), Izz, about a vertical axis extending through the center of gravity, thereby increasing the resistance of the putter head 10 to twisting when the putter head strikes a golf ball. Thus, when the putter head 10 strikes a golf ball at a location that is off-center from the center of gravity, the putter head is less likely to twist in the player's hand, thereby increasing the likelihood that the ball will follow its intended course. The mass of weights 44 can be selected to further move the CG rearward from the front face 26 and to further increase the MOI.

In certain embodiments, the putter head 10 has a MOI greater than 400 kilogram millimeters squared (kg-mm$^2$), and a CG located greater than 30 mm from the front face 26 (indicated by the distance CGy in FIG. 4) and less than 13 mm from a horizontal ground plane P contacting the bottom surface 66 (indicated by the distance CGz in FIG. 4). As used herein, the horizontal ground plane P refers to the horizontal plane that contacts the lowermost location on the bottom surface of the putter head when the putter head is held in a resting position contacting the ground with the shaft substantially perpendicular to the plane P. It is believed that these properties have never before been achieved in a golf putter head having an overall size and weight that conforms to USGA rules. In an exemplary embodiment, the putter head 10 has a MOI of about 404 kg-mm$^2$, and a CG located at a distance CGy from the front face 26 of about 33.6 mm and a distance CGz from the ground plane P of about 12.5 mm.

The location of the center of gravity and the moment of inertia relative to the overall mass of the putter head (m) can be expressed by the ratios CGy/m, CGz/m, and MOI/m. In an exemplary embodiment, the putter head 10 has a weight of about 324 grams (excluding weights), a MOI of about 404 kg-mm$^2$, and a CG located at a distance CGy from the front face 26 of about 33.6 mm and a distance CGz from the ground plane P of about 12.5 mm. Such a putter head can achieve a ratio CGy/m of about 0.104 mm/g, a ratio CGz/m of about 0.039 mm/g, and a ratio MOI/m of about 1.25 kg-mm$^2$/g.

The main body 12 and the insert 30 may be formed from any of various suitable materials, including metal/metal alloys, polymers, composites, ceramics, or various combinations thereof. Generally, an insert 30 formed from a metallic material provides the putter head 10 with a more solid feel during impact with a golf ball, whereas an insert 30 formed from a polymeric material, such as plastic, provides a softer feel than a metallic insert. The insert 30 may be manufactured of the same material as the main body 12 or it may be manufactured of a different material.

Some examples of metals and metal alloys that can be used to form the insert 30 or the main body 12 include, without limitation, carbon steels (e.g., 1020 or 8620 carbon steel), stainless steels (e.g., 304 or 410 stainless steel), PH (precipitation-hardenable) alloys (e.g., 17-4, C450, or C455 alloys), titanium alloys (e.g., 3-2.5, 6-4, SP700, 15-3-3-3, 10-2-3, or other alpha/near alpha, alpha-beta, and beta/near beta titanium alloys), aluminum/aluminum alloys (e.g., 3000 series alloys, 5000 series alloys, 6000 series alloys, such as 6061-T6, and 7000 series alloys, such as 7075), magnesium alloys, copper alloys, and nickel alloys.

Some examples of composites that can be used to form the insert 30 or the main body 12 include, without limitation, glass fiber reinforced polymers (GFRP), carbon fiber reinforced polymers (CFRP), metal matrix composites (MMC), ceramic matrix composites (CMC), and natural composites (e.g., wood composites).

Some examples of polymers that can be used to form the insert 30 or the main body 12 include, without limitation, thermoplastic materials (e.g., polyethylene, polypropylene, polystyrene, acrylic, PVC, ABS, polycarbonate, polyurethane, polyphenylene oxide (PPO), polyphenylene sulfide (PPS), nylon, and engineered thermoplastics), thermosetting materials (e.g., polyurethane, epoxy, and polyester), copolymers, and elastomers (e.g., natural or synthetic rubber, EPDM, and Teflon®).

Some examples of ceramics that can be used to form the insert 30 or the main body 12 include, without limitation, oxides (e.g., titanium oxide, aluminum oxide, magnesium oxide, and silicon oxide), carbides (e.g., titanium carbide, tungsten carbide, silicon carbide, and boron carbide), and nitrides (e.g., silicon nitride).

The main body 12 can be formed as a unitary, monolithic structure (i.e., a single structure without any welds or fasteners connecting different parts of the body) or from multiple structures that are separately formed and subsequently joined to each other using known manufacturing techniques. Such techniques can include investment casting, milling, forging, metal injection molding, and the like.

The insert 30 can be formed using conventional manufacturing techniques, such as, for example, die casting, injection molding, extrusion, forging, saw cutting, EDM (electrical discharge machining), etc. Any of the foregoing manufacturing techniques also can be used if the projections (not shown) are formed directly in the front face 26 of the main body 12, rather than in an insert. The insert 30 and/or the main body 12 can be subjected to various surface treatments, such as, for example, anodizing, nitriding, PVD (physical vapor deposition) or CVD (chemical vapor deposition) to improve corrosion resistance, abrasion resistance, hardness, or other characteristics of the components.

EXAMPLE

A putter head 10 was cast from 304 stainless steel. The putter head had an overall length L (FIG. 3) of about 76.3 mm, an overall width W (FIG. 3) of about 107.1 mm, and an overall height H (FIG. 8) of about 25.4 mm, and a weight of about 324 grams (excluding weights 44). The putter head 10 had a MOI of about 404 kg-mm$^2$, a CG located at a distance CGy from the front face 26 of about 33.6 mm and a distance CGz from the ground plane P of about 12.5 mm. The front plate 50 has a thickness T (FIG. 4) of about 5.7 millimeters.

Of course, these specific dimensions (as well as other dimensions provided in the present specification) are given to illustrate the invention and not to limit it. The dimensions provided herein can be modified as needed in different applications or situations.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. A putter head comprising:

a body having a front striking surface, a bottom surface, a center of gravity located at least 30 mm rearward from the striking surface and less than about 13 mm from a horizontal ground plane contacting the bottom surface, and a moment of inertia of at least 400 kg-mm$^2$ a face portion defining the front striking surface in a front portion;

a rear portion;

a heel portion extending from the face portion to the rear portion;

a toe portion extending from the face portion to the rear portion, the heel and toe portions being on opposite sides of the longitudinal axis of symmetry of the putter head;

a central portion located between the heel portion and the toe portion and extending from the face portion to the rear portion;

wherein the heel portion and the central portion define a first main opening in the putter head and the toe portion and the central portion define a second main opening in the putter head and the heel portion and the toe portions extend between respective ends of the front portion and the rear portion, the heel portion and the toe portion converging from the front portion to the rear portion; and wherein the heel portion includes at least one first member extending a majority of the length of the putter head and the toe portion includes at least one second member extending a majority of the length of the putter head to converge in the rear portion; and at least one removable weight and at least one cavity formed in the putter head body for receiving the at least one removable weight.

2. The putter head of claim 1, wherein the heel portion includes a first side opening extending the majority of the length of the putter head and the toe portion includes a second side opening extending the majority of the length of the putter head.

3. The putter head of claim 1, wherein the face portion, the rear portion, the heel portion, the toe portion, and the central portion comprise a one-piece, monolithic construction.

4. The putter head of claim 3, wherein the face portion, the rear portion, the heel portion, the toe portion, and the central portion are cast.

5. The putter head of claim 1, wherein the body has a moment of inertia of at least 404 kg-mm$^2$.

6. The putter head of claim 1, wherein the center of gravity is located at least 33.6 mm rearward from the striking surface.

7. The putter head of claim 1, wherein the center of gravity is located 12.5 mm or less from the ground plane.

8. The putter head of claim 1, wherein the face portion comprises a vertically disposed, laterally extending first plate and the central portion comprises a vertically disposed, laterally extending second plate spaced rearwardly from the first plate, the face portion comprising a crown portion interconnecting the first and second plates at the upper edges thereof, the second plate having a width that is less than that of the first plate.

9. The putter head of claim 8, wherein the first plate has a thickness of about 5.7 mm or less.

10. The putter head of claim 1, having a weight of about 355 grams or less.

11. The putter head of claim 1, having a weight of about 345 grams or less.

12. The putter head of claim 1, wherein the body comprises a recess and an insert disposed in the recess and defining at least a portion of the front striking surface.

13. A putter head comprising:

a body having a front striking surface, a bottom surface, a center of gravity located at least 30 mm rearward from the striking surface and less than about 13 mm from a horizontal ground plane contacting the bottom surface, and a moment of inertia of at least 400 kg-mm$^2$ a face portion defining the front striking surface in a front portion;

a rear portion;

a heel portion extending from the face portion to the rear portion;

a toe portion extending from the face portion to the rear portion, the heel and toe portions being on opposite sides of the longitudinal axis of symmetry of the putter head;

a central portion located between the heel portion and the toe portion and extending from the face portion to the rear portion;

wherein the heel portion and the central portion define a first main opening in the putter head and the toe portion and the central portion define a second main opening in the putter head and the heel portion and the toe portions extend between respective ends of the front portion and the rear portion, the heel portion and the toe portion converging from the front portion to the rear portion;

wherein the heel portion includes at least one first member extending a majority of the length of the putter head and the toe portion includes at least one second member extending a majority of the length of the putter head to converge in the rear portion; and the face portion comprises a generally vertically disposed front plate and a crown portion extending rearwardly from an upper edge of the plate;

the central portion comprises a generally vertically disposed rear plate spaced rearwardly of and in a substantially parallel relationship with respect to the front plate, the rear plate being connected to and extending downwardly from the crown portion, the central portion further comprising a centrally located rib interconnecting the rear plate and the front plate.

14. The putter head of claim 13, wherein the central portion comprises an enlarged aft-mass portion connected to the rear portion and a generally vertically disposed, longitudinally extending plate interconnecting the rear plate and the aft-mass portion and being aligned with the sweet spot of the putter head.

15. A method of making a putter head for a golf club, the method comprising forming a putter head body having a front striking surface, a bottom surface, a center of gravity located at least 30 mm rearward from the striking surface and less than about 13 mm from a horizontal ground plane contacting the bottom surface, and a moment of inertia of at least 400 kg-mm$^2$;

forming a face portion defining the front striking surface in a front portion, the face portion comprises a generally vertically disposed front plate and a crown portion extending rearwardly from an upper edge of the plate;

forming a rear portion;

forming a heel portion extending from the face portion to the rear portion;

forming a toe portion extending from the face portion to the rear portion, the heel and toe portions being on opposite sides of the longitudinal axis of symmetry of the putter head;

forming a central portion located between the heel portion and the toe portion and extending from the face portion to the rear portion, the central portion comprises a generally vertically disposed rear plate spaced rearwardly of and in a substantially parallel relationship with respect to the front plate, the rear plate being connected to and extending downwardly from the crown portion, the central portion further comprising a centrally located rib interconnecting the rear plate and the front plate;

wherein the heel portion and the central portion define a first main opening in the putter head and the toe portion and the central portion define a second main opening in the putter head and the heel portion and the toe portions extend between respective ends of the front portion and the rear portion, the heel portion and the toe portion converging from the front portion to the rear portion; and wherein the heel portion includes at least one first member extending a majority of the length of the putter head and the toe portion includes at least one second member extending a majority of the length of the putter head to converge in the rear portion.

16. The method of claim 15, wherein the act of forming the putter head body comprises casting the putter head body.

17. The method of claim 15, wherein the act of forming the putter head body comprises forming the body as a unitary, monolithic structure.

18. The method of claim 15, wherein the body is cast from stainless steel.

19. A putter head comprising:

a body having a front striking surface, a bottom surface, a center of gravity located at least 30 mm rearward from the striking surface and less than about 13 mm from a horizontal ground plane contacting the bottom surface, and a moment of inertia of at least 400 kg-mm$^2$ a face portion defining the front striking surface in a front portion;

a rear portion;

a heel portion extending from the face portion to the rear portion;

a toe portion extending from the face portion to the rear portion, the heel and toe portions being on opposite sides of the longitudinal axis of symmetry of the putter head;

a central portion located between the heel portion and the toe portion and extending from the face portion to the rear portion;

wherein the heel portion and the central portion define a first main opening in the putter head and the toe portion and the central portion define a second main opening in the putter head and the heel portion and the toe portions extend between respective ends of the front portion and the rear portion, the heel portion and the toe portion converging from the front portion to the rear portion; and wherein the heel portion includes two first members extending a majority of the length of the putter head and the toe portion includes two second members extending a majority of the length of the putter head to converge in the rear portion.

* * * * *